US009795216B1

(12) United States Patent
Chen et al.

(10) Patent No.: US 9,795,216 B1
(45) Date of Patent: Oct. 24, 2017

(54) DRIVING MECHANISM AND DRIVING METHOD FOR FURNITURE PARTS

(71) Applicants: KING SLIDE WORKS CO., LTD., Kaohsiung (TW); KING SLIDE TECHNOLOGY CO.,LTD., Kaohsiung (TW)

(72) Inventors: Ken-Ching Chen, Kaohsiung (TW); Hsiu-Chiang Liang, Kaohsiung (TW); Ci-Bin Huang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 15/335,457

(22) Filed: Oct. 27, 2016

(30) Foreign Application Priority Data

Mar. 31, 2016 (TW) ..... 105110554 A

(51) Int. Cl.
*A47B 95/02* (2006.01)
*A47B 88/04* (2006.01)
*A47B 88/08* (2006.01)

(52) U.S. Cl.
CPC ..... *A47B 88/0481* (2013.01); *A47B 88/08* (2013.01); *A47B 2210/0048* (2013.01); *A47B 2210/0056* (2013.01); *A47B 2210/0094* (2013.01)

(58) Field of Classification Search
CPC ..... A47B 88/0481; A47B 88/08; A47B 2210/0048; A47B 2210/0056; A47B 2210/0094
See application file for complete search history.

(56) References Cited

U.S. PATENT DOCUMENTS

| | | | | |
|---|---|---|---|---|
| 8,172,345 | B2 | 5/2012 | Liang | |
| 8,668,288 | B2 | 3/2014 | Salice | |
| 8,721,011 | B2 | 5/2014 | Salice | |
| 8,764,134 | B2 | 7/2014 | Salice | |
| 9,211,007 | B2 * | 12/2015 | Brunnmayr | A47B 88/04 |
| 2009/0273263 | A1 * | 11/2009 | Berger | A47B 88/47 312/334.1 |
| 2013/0134852 | A1 * | 5/2013 | Salice | A47B 88/47 312/319.1 |

(Continued)

FOREIGN PATENT DOCUMENTS

| | | | |
|---|---|---|---|
| EP | 3 167 752 | A1 | 5/2017 |
| WO | 2013073489 | A1 | 5/2013 |

*Primary Examiner* — Hanh V Tran
(74) *Attorney, Agent, or Firm* — Winston Hsu

(57) ABSTRACT

A driving mechanism includes a first elastic member, a first locking device, a second elastic member and a second locking device. The first locking device is configured to allow the elastic member to release a first elastic force in an unlocking state. The second locking device is connected to the second elastic member. When a first furniture part is moved a predetermined distance relative to a second furniture part from an open position toward a retracted position, the first locking member is switched from the unlocking state to a locking state in order to accumulate the first elastic force, and the first furniture part is moved from the open position to the retracted position in response to a second elastic force of the second elastic member.

20 Claims, 17 Drawing Sheets

(56) References Cited

U.S. PATENT DOCUMENTS

| | | | | |
|---|---|---|---|---|
| 2014/0300262 | A1* | 10/2014 | Flogaus | A47B 88/0481 312/319.1 |
| 2014/0363107 | A1* | 12/2014 | Egger | F16C 29/02 384/21 |
| 2015/0108891 | A1* | 4/2015 | Brunnmayr | A47B 88/0481 312/319.8 |
| 2016/0206093 | A1* | 7/2016 | Brunnmayr | A47B 88/0481 |

* cited by examiner

DRIVING MECHANISM AND DRIVING METHOD FOR FURNITURE PARTS

BACKGROUND OF THE INVENTION

1. Field of the Invention

The present invention relates to a driving mechanism and a driving method, and more particularly, to a driving mechanism and a driving method for furniture parts.

2. Description of the Prior Art

In a furniture system, such as a drawer system, a drawer usually can be opened or retracted relative to a cabinet through a pair of slide rail assemblies. A product capable of facilitating a drawer to open from a retracted position relative to a cabinet is already provided in current market, and the product is so called a push-open product. A product capable of automatically retracting a drawer relative to a cabinet in an end process of retracting is also provided in current market, and the product is so called a self-closing product. However, according to different requirements in the market, a product with both push-open and self-closing functions becomes important in product development. U.S. Pat. No. 8,172,345 B2 discloses a self-moving device for movable furniture parts, which comprises a movable part with self-opening and self-closing functions relative to a stationary part. The case is provided for reference.

SUMMARY OF THE INVENTION

The preset invention relates to a driving mechanism and a driving method for furniture parts.

According to an embodiment of the present invention, a driving mechanism is configured to drive a first furniture part to move relative to a second furniture part. The driving mechanism comprises a first elastic member, a first locking device, a second elastic member and a second locking device. The first locking device is configured to releasably lock the first elastic member. Wherein, when the first locking device locks the first elastic member, the first elastic member accumulates a first elastic force; and when the first locking device releases the first elastic member, the first elastic member releases the first elastic force to drive the first furniture part to move relative to the second furniture part from a retracted position toward an open position along a first direction. The second locking device is connected to the second elastic member. When the first furniture part is moved a predetermined distance relative to the second furniture part from the open position toward the retracted position along a second direction, the first locking device is switched from an unlocking state to a locking state in order to lock the first elastic member, and the second elastic member generates a second elastic force, such that the first furniture part is moved relative to the second furniture part from the open position to the retracted position along the second direction in response to the second elastic force.

According to another embodiment of the present invention, a furniture part comprises a first furniture part, a second furniture part and a driving mechanism. The first furniture part is movable relative to the second furniture part from a retracted position toward an open position. The driving mechanism comprises a first locking device. The first locking device comprises a first component, a second component and a control member. The first component is movable on the second furniture part. The second component is movably connected to the first component. The control member is configured to be in one of a locking state and an unlocking state relative to the second component. Wherein when the control member is in the locking state, the control member does not engage with the second component, such that the first component can be moved relative to the second furniture part from the retracted position toward the open position along a first direction. Wherein when the control member is in the unlocking state, the control member engages with the second component, such that the first component is not movable relative to the second furniture part along a second direction. Wherein when the first furniture part is moved a predetermined distance relative to the second furniture part from the open position toward the retracted position along the second direction, the control member is switched from the unlocking state to the locking state.

According to another embodiment of the present invention, the present invention provides a driving method for moving a first furniture part relative to a second furniture part. The first furniture part is movable relative to the second furniture part from a retracted position toward an open position along a first direction. The driving method comprises providing a first elastic member; providing a first locking device configured to releasably lock the first elastic member, wherein when the first furniture part is moved relative to the second furniture part along a second direction by an external force to allow the first locking device to unlock the first elastic member, the first elastic member releases a first elastic force, and the first furniture part is moved relative to the second furniture part from the retracted position to the open position along the first direction in response to the first elastic force; and providing a second elastic member, wherein when the first furniture part is moved a predetermined distance relative to the second furniture part from the open position toward the retracted position by an external force to allow the first locking device to lock the first elastic member, the second elastic member is configured to release a second elastic force, and the first furniture part is moved relative to the second furniture part form the open position to the retracted position along the second direction in response to the second elastic force.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
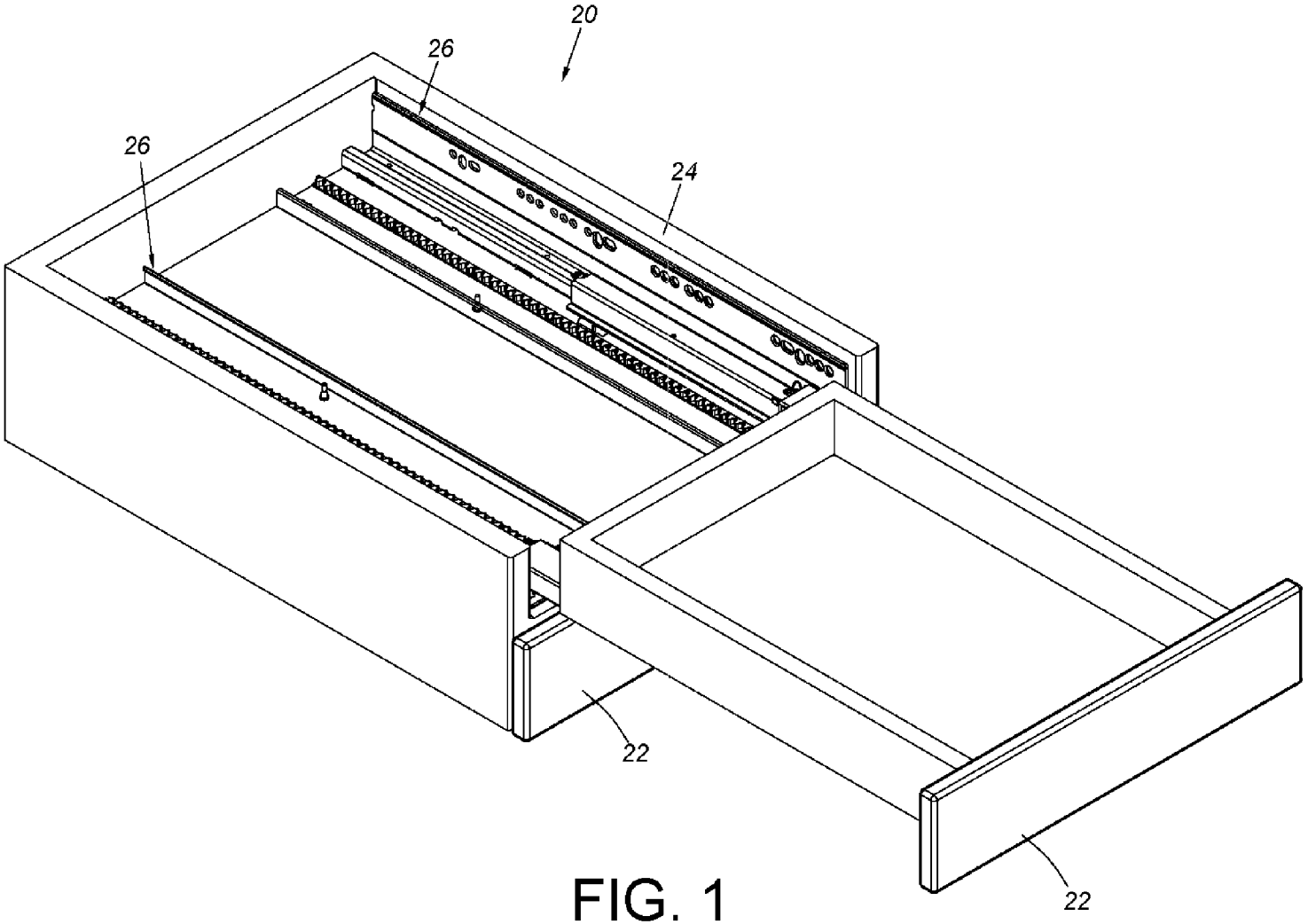
FIG. 1 is a diagram showing a drawer being opened relative to a cabinet according to an embodiment of the present invention.

FIG. 1 shows a furniture assembly 20 at least comprising a first furniture part 22, a second furniture part 24 and a pair of slide rail assemblies 26 according to an embodiment of the present invention. In the present embodiment, the first furniture part 22 is a drawer for example, and the second furniture part 24 is a cabinet for example. The pair of the slide rail assemblies 26 is mounted between the first furniture part 22 and the second furniture part 24. In the present embodiment, the slide rail assemblies 26 are undermount drawer slides, and are respectively mounted to the first furniture part 22 to be adjacent to two sides of a bottom of the first furniture part 22. According to the above arrangement, the first furniture part 22 can be easily opened or retracted relative to the second furniture part 24 through the pair of slide rail assemblies 26.

Figure 2:
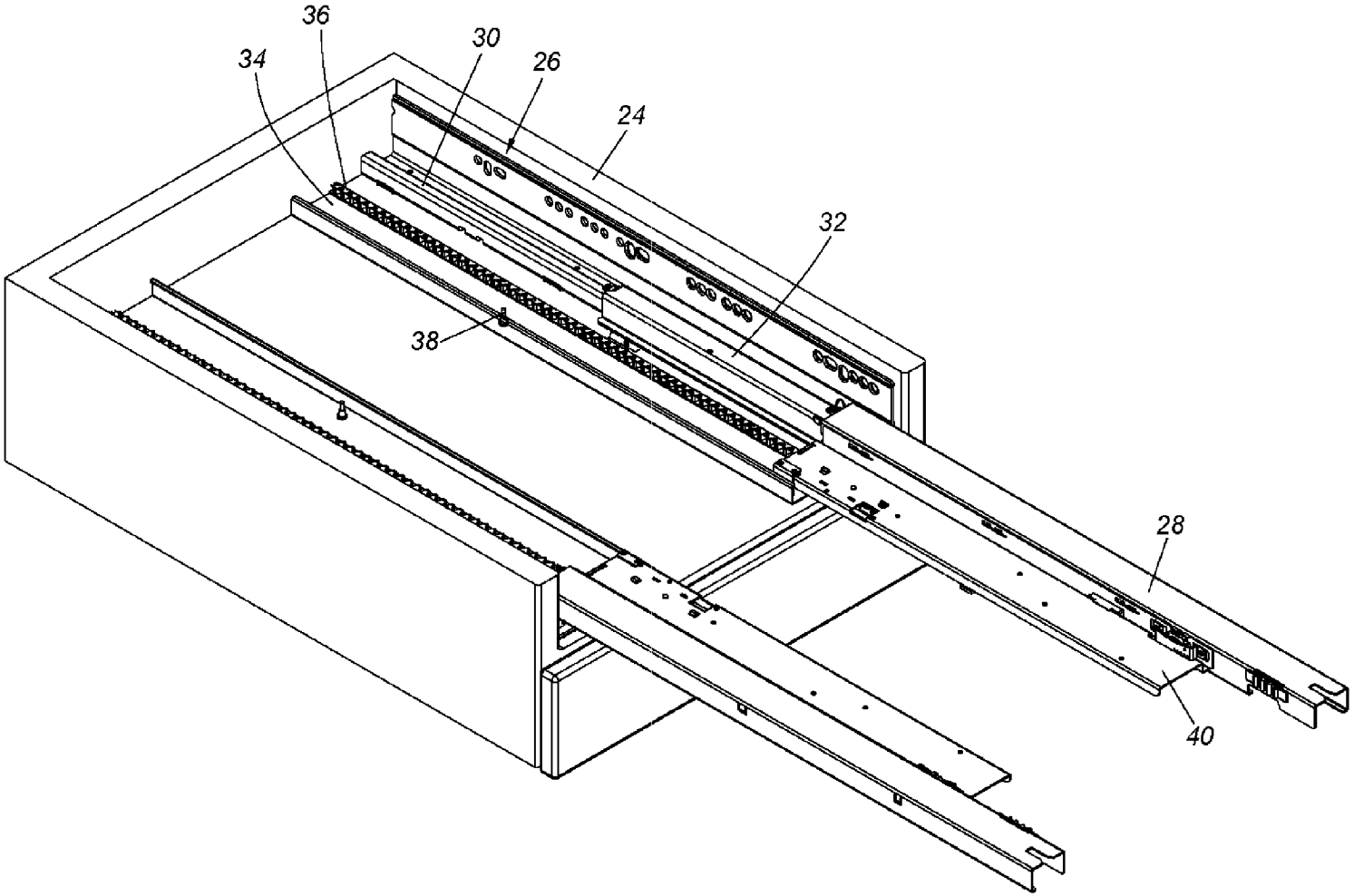
FIG. 2 is a diagram showing the cabinet of FIG. 1 with the drawer being removed.
Figure 3:
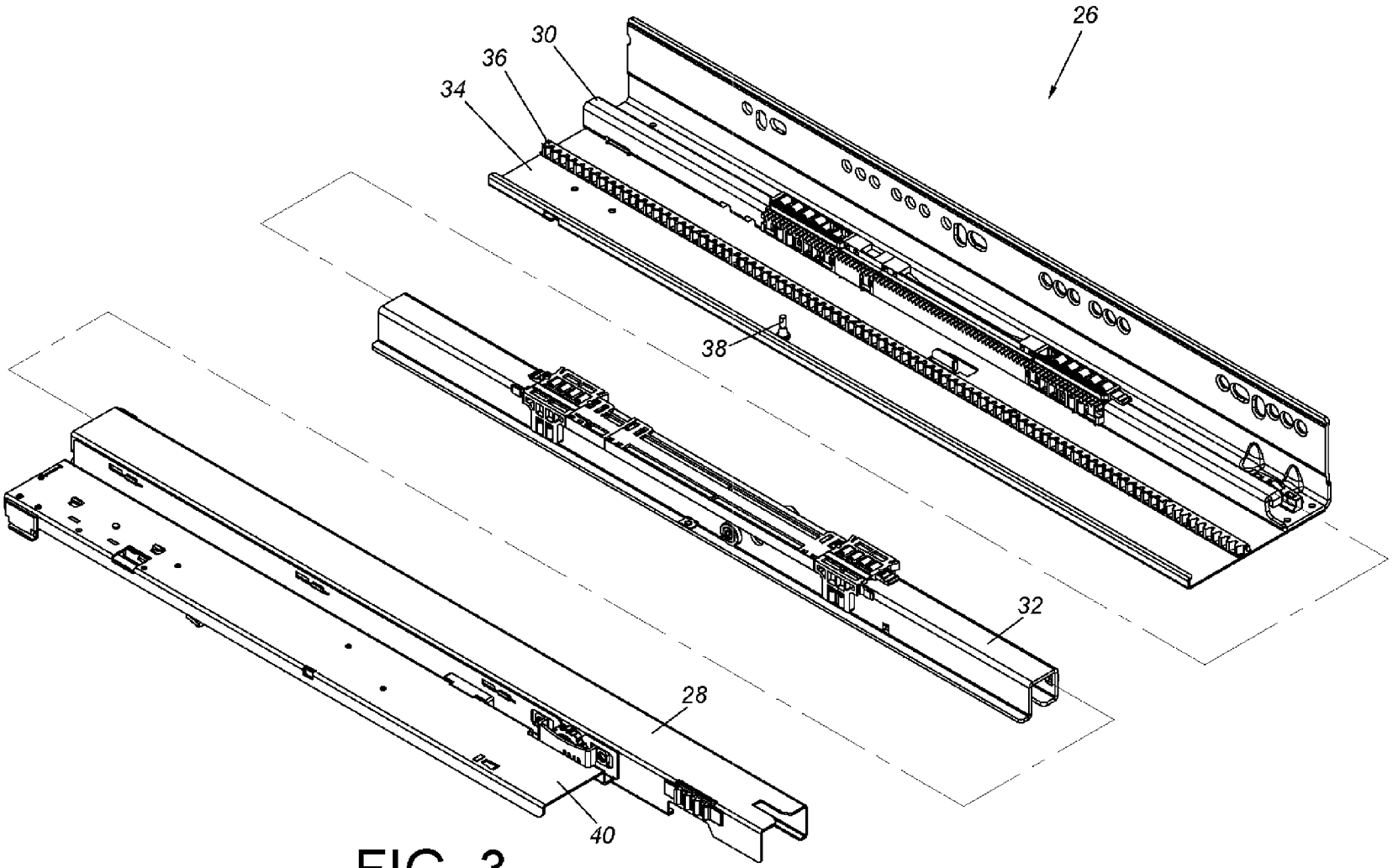
FIG. 3 is an exploded view of a slide rail assembly according to an embodiment of the present invention.

As shown in FIG. 2 and FIG. 3, the slide rail assembly 26 comprises a first rail 28 and a second rail 30. The second rail 30 is longitudinally and fixedly mounted to the second furniture part 24. As such, the second rail 30 can be seen as a portion of the second furniture part 24. The first rail 28 is longitudinally movable relative to the second rail 30. As such, the first rail 28 can be seen as a portion of the first furniture part 22. Preferably, the slide rail assembly 26 further comprises a third rail 32 movably mounted between the first rail 28 and the second rail 30. The third rail 32 is configured to extend a traveling distance of the first rail 28 relative to the second rail 30. Preferably, the slide rail assembly 26 further comprises an extension base 34 fixedly attached to the second rail 30. The extension base 34 can be seen as a portion of the second rail 30, and the extension base 34 is arranged along a longitudinal direction of the second rail 30. Preferably, the slide rail assembly 26 further comprises an auxiliary track 36 arranged along a longitudinal direction of the extension base 34. In the present embodiment, the auxiliary track 36 is a gear rack. The extension base 34 further comprises an engagement feature 38. The engagement feature 38 can be an independent component fixedly attached on the extension base 34, or the engagement feature 38 can be formed from the extension base 34.

Figure 4:
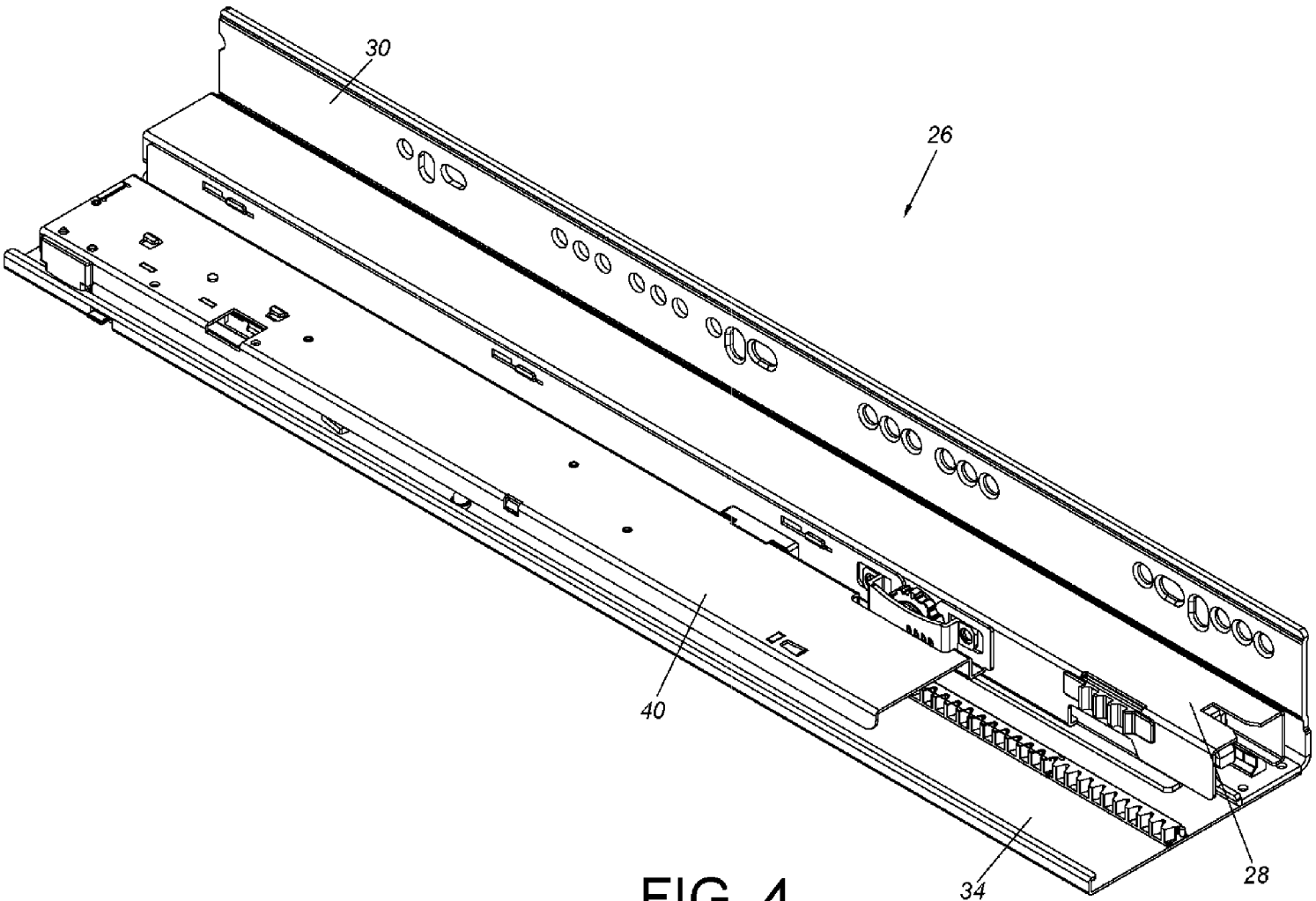
FIG. 4 is a diagram showing the slide rail assembly in a retracted state according to an embodiment of the present invention.

As shown in FIG. 4, the slide rail assembly 26 further comprises a carrying member 40 mounted to the first rail 28. The carrying member 40 can be seen as a portion of the first rail 28 (that is to say, the carrying member 40 can be seen as a portion of the first furniture part 22), and is configured to be moved with the first rail 28 relative to the second rail 30. The carrying member 40 is movable relative to the extension base 34. FIG. 4 is a diagram showing the first rail 28 being in a retracted state relative to the second rail 30. In other words, the carrying member 40 is retracted relative to the extension base 34.

Figure 5:
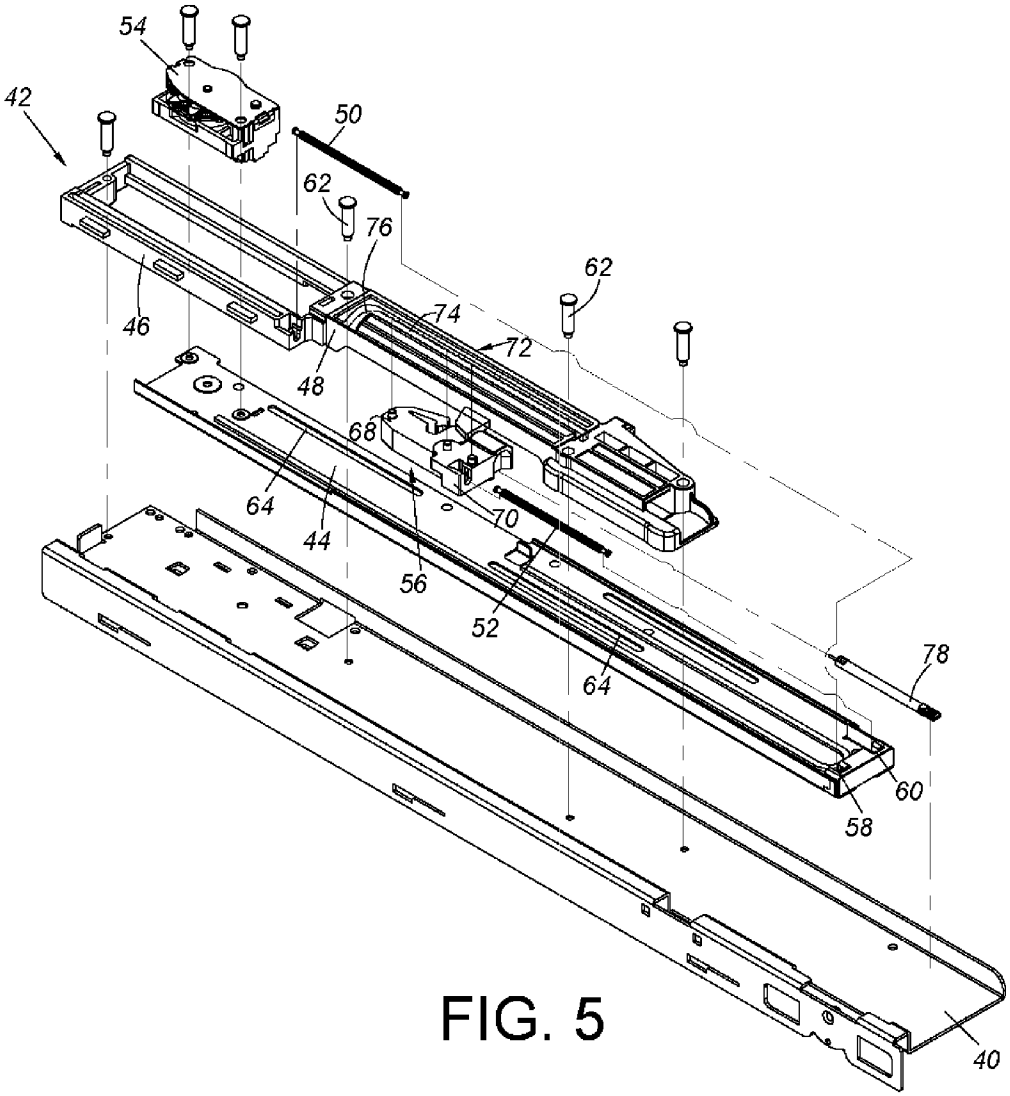
FIG. 5 is an exploded view of a driving mechanism and a carrying member according to an embodiment of the present invention.
Figure 6:
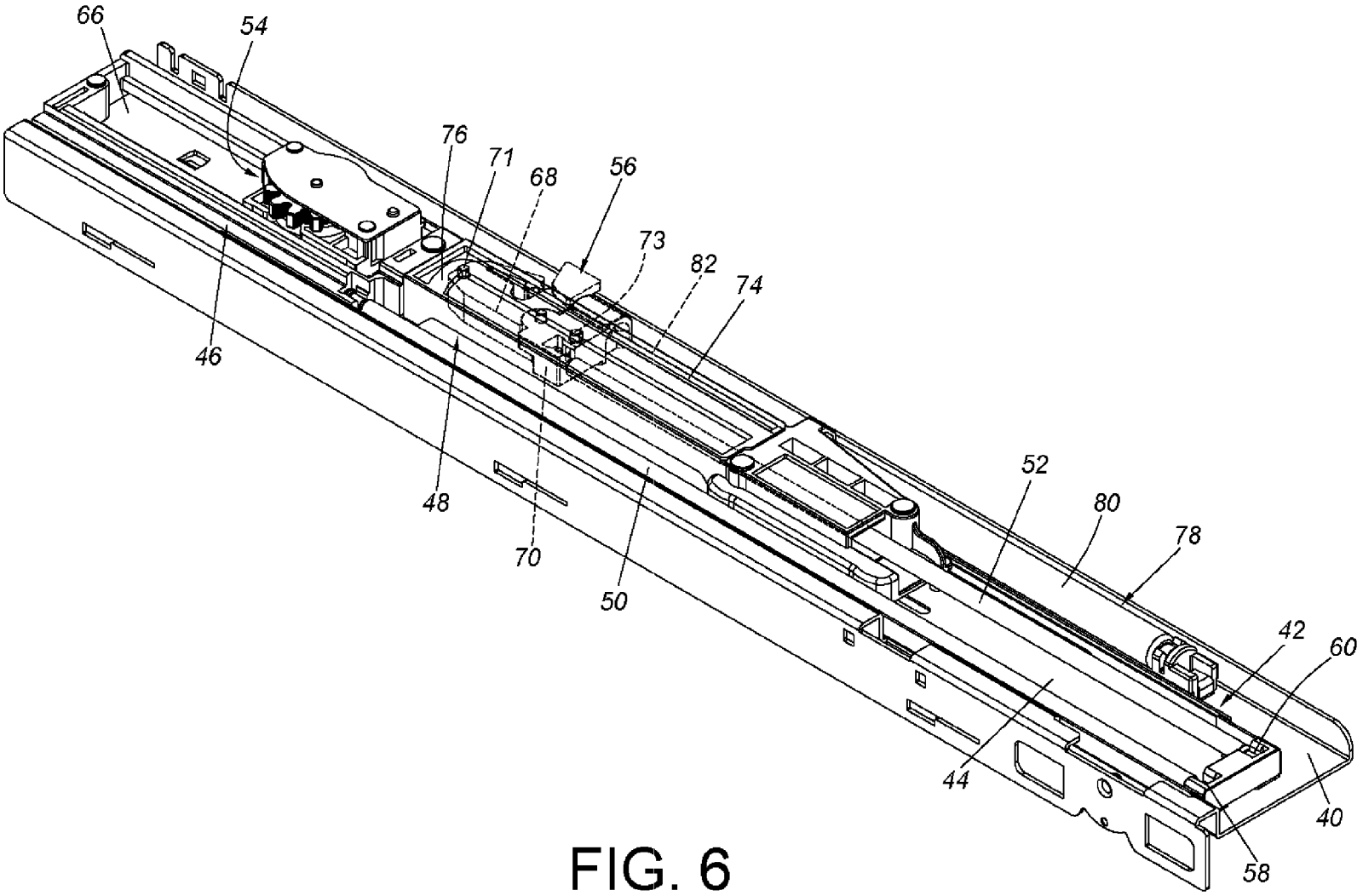
FIG. 6 is a diagram showing the driving mechanism and the carrying member of FIG. 5.

As shown in FIG. 5 and FIG. 6, the present invention provides a driving mechanism 42. The driving mechanism 42 is arranged on the carrying member 40. In particular, the driving mechanism 42 comprises a plurality of components, such as a connecting member 44, a first base 46, a second base 48, a first elastic member 50, a second elastic member 52, a first locking device 54 and a second locking device 56.

The connecting member 44 is movable relative to the carrying member 40 (or the first furniture part 22). Preferably, the connecting member 44 is arranged with a first mounting part 58 and a second mounting part 60.

The first base 46 is arranged adjacent to the second base 48. For example, the second base 48 is mounted to one side of the first base 46, such that the first base 46 and the second base 48 can be seen as one piece. One of the first base 46 and the second base 48 is connected to the carrying member 40. Preferably, the first base 46 and the second base 48 are arranged with at least one fixing member 62, such as a plurality of fixing members 62. On the other hand, the connecting member 44 is arranged with at least one extension hole 64, such as a plurality of extension holes 64 located at positions corresponding to the plurality of fixing members 62. The plurality of extension holes 64 allows the connecting member 44 to be movable relative to the first base 46 or the second base 48. In particular, each of the fixing members 62 passes through a portion of a corresponding extension hole 64 and is connected to the carrying member 40 (or the first furniture part 22). Wherein, the fixing member 62 and the extension hole 64 respectively are a protrusion and a bounded hole (such as a longitudinal hole).

The first elastic member 50 is mounted to the connecting member 44. Preferably, the first elastic member 50 can be mounted between the first base 46 and the first mounting part 58 of the connecting member 44. On the other hand, the second elastic member 52 is mounted between the connecting member 44 and the second locking device 56.

The first locking device 54 is arranged on the connecting member 44. The first locking device 54 is configured to releasably lock the first elastic member 50. In addition, the first base 46 provides a space 66 for accommodating the first locking device 54.

The second locking device 56 comprises a capturing member 68 and a blocking member 70. In the present embodiment, the capturing member 68 is movably connected, such as pivoted, to the blocking member 70. Wherein, the blocking member 70 of the second locking device 56 is connected to the second elastic member 52. For example, the second elastic member 52 can be mounted between the blocking member 70 of the second locking device 56 and the second mounting part 60 of the connecting member 44. In the present embodiment, the second locking device 56 is movably mounted to the second base 48. In particular, the second base 48 has a guiding path 72. The guiding path 72 comprises a longitudinal path 74 and a transverse path 76 communicated with the longitudinal path 74 and deflected relative to the longitudinal path 74. The capturing member 68 and the blocking member 70 are movable along the longitudinal path 74 of the guiding path 72. In the present embodiment, the capturing member 68 and the blocking member 70 respectively have a first pin 71 and a second pin 73 movable in the longitudinal path 74 of the guiding path 72.

Preferably, the driving mechanism 42 further comprises a damping device 78. The damping device 78 comprises a cylinder 80 and a damping rod 82 movable relative to the cylinder 80. The damping device 78 is well known to those skilled in the art, therefore, no further illustration is provided. Wherein, the damping rod 82 is located at a position corresponding to one of the capturing member 68 and the blocking member 70. In the present embodiment, the damping rod 82 is located at a position corresponding to the blocking member 70 for example.

Figure 7:
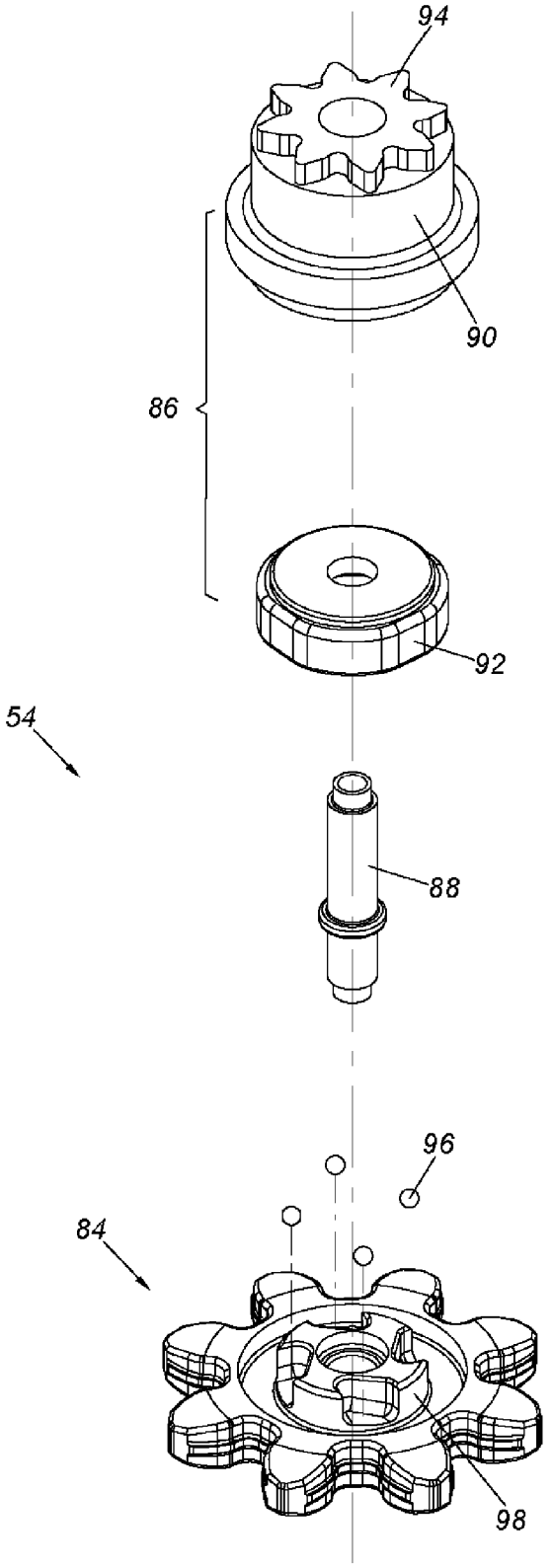
FIG. 7 is an exploded view of some of components of a first locking device of the driving mechanism according to an embodiment of the present invention.

As shown in FIG. 7, the first locking device 54 comprises a first component 84 and a second component 86 movably connected to the first component 84. In the present invention, the first component 84 and the second component 86 are pivoted to each other by a shaft 88. The first component 84 is movable on the second furniture part 24. For example, the first component 84 is movable along the auxiliary track 36. In particular, the first component 84 is meshed to the auxiliary track 36 of the extension base 34 of the second rail 30 to be movable along the auxiliary track 36. The second component 86 comprises two parts, such as a main body part 90 and a housing part 92. The main body part 90 and the housing part 92 can be formed in one piece. Or, the main body part 90 can have a mounting space (not shown) for accommodating the housing part 92. As such, when the housing part 92 is mounted to the main body part 90, the main body part 90 and the housing part 92 can be seen as one piece. Wherein, the main body part 90 has a plurality of engagement sections 94 separated from each other.

Figure 8:
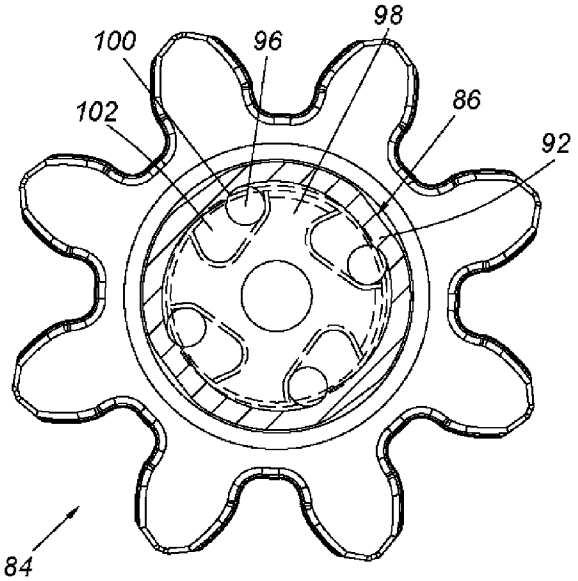
FIG. 8 is a diagram showing two components abutting against each other when an abutting member of the first locking device is located at a predetermined position according to an embodiment of the present invention.
Figure 9:
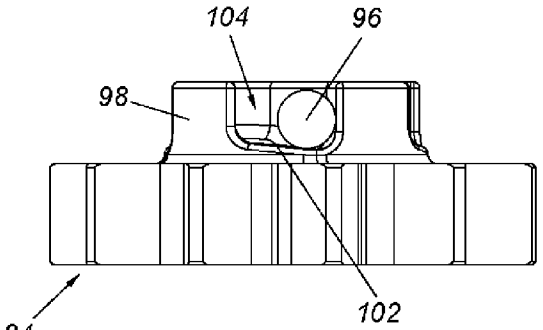
FIG. 9 is a diagram showing the abutting member of FIG. 8 in another angle.

As shown in FIG. 8 and FIG. 9, the first locking device 54 further comprises at least one abutting member 96 movably mounted between the first component 84 and the second component 86 (such as the housing part 92). In particular, the first component 84 is arranged with at least one first abutting part 98, and the second component 86 (such as the housing part 92) is arranged with at least one second abutting part 100. In addition, the first component 84 has an inclined face 102. Wherein, an abutting space 104 is defined between the first abutting part 98 of the first component 84 and the second abutting part 100 of the second component 86 for accommodating the abutting member 96. Preferably, the inclined face 104 is arranged on the first component 84 and adjacent to the first abutting part 98. The abutting member 96 is movable on the inclined face 102. For example, when the first component 84 is rotated along a first moving direction, the abutting member 96 is moved to a predetermined position on the inclined face 102 to abut against the first abutting part 98 of the first component 84 and the second abutting part 100 of the second component 86, such that the first component 84 can drive the second component 86 to move along the first moving direction through the abutting member 96.

Figure 10:
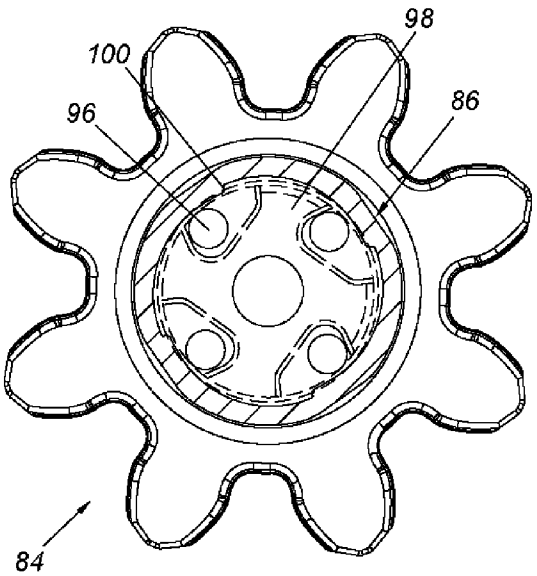
FIG. 10 is a diagram showing the abutting member of the first locking device away from the predetermined position according to an embodiment of the present invention.
Figure 11:
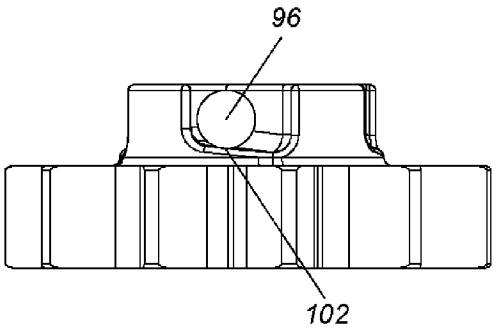
FIG. 11 is a diagram showing the abutting member of FIG. 10 in another angle.

As shown in FIG. 10 and FIG. 11, when the first component 84 is rotated along a second moving direction (different from the first moving direction), the abutting member 96 is driven by the first abutting part 98 of the first component 84 to move, such that the abutting member 96 is apart from the predetermined position on the inclined face 102. Thus the first component 84 is not able to drive the second component 86 to move along the second moving direction through the abutting member 96.

Figure 12:
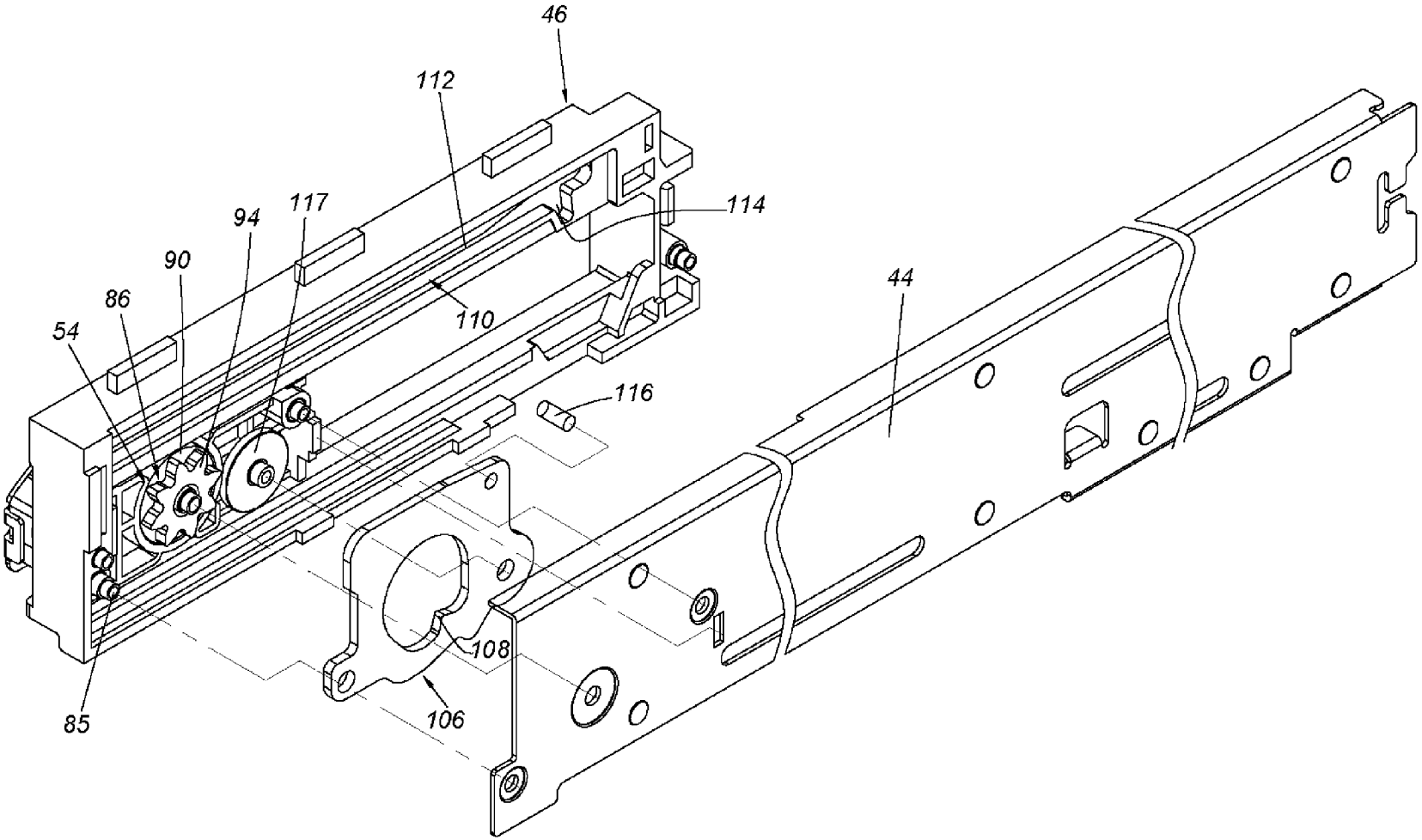
FIG. 12 is a diagram showing the first locking device being located adjacent to a first base and mounted to a connecting member, wherein the first locking device has a control member corresponding to a control path according to an embodiment of the present invention.

As shown in FIG. 12, the first locking device 54 further comprises a control member 106 movable relative to the second component 86. In the present embodiment, the control member 106 is pivoted relative to the second component 86. For example, a portion of the control member 106 is pivoted to the connecting member 44 by a pivoting member 85, so as to allow the control member 106 to rotate and deflect relative to the second component 86. Preferably, the control member 106 has a control part 108 corresponding to the engagement section 94 of the second component 86. Preferably, one of the control member 106 and the first base 46 is formed a control path 110. In the present embodiment, the first base 46 is formed with the control path 110 for example. The control path 110 comprises a first path 112 and a second path 114 communicated with the first path 112 and deflected relative to the first path 112. On the other hand, the control path 110 allows the control member 106 to move relative to the first base 46 or the second component 86. Preferably, another portion of the control member 106 is arranged with a guiding member 116 to cooperate with the control path 110. Preferably, the first locking device 54 further comprises a rolling member 117 in rolling contact with the first base 46 for reducing friction caused by movement of the first base 46 relative to the first locking device 54.

Figures 13, 14, 15:
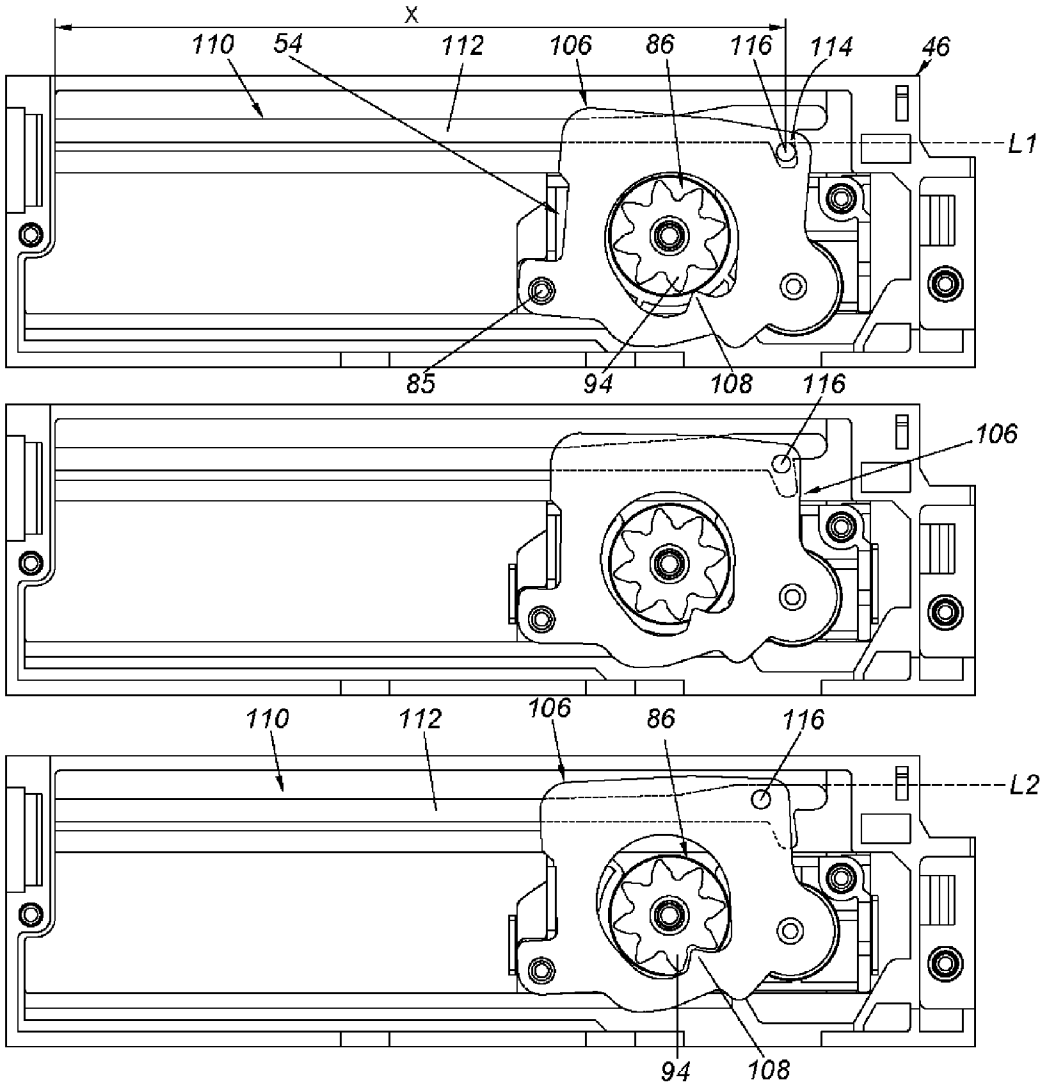
FIG. 13 is a diagram showing the first locking device being in a locking state relative to the first base according to an embodiment of the present invention.
FIG. 14 is a diagram showing the first locking device of FIG. 13 gradually moving away from the locking state.
FIG. 15 is a diagram showing the first locking device of FIG. 14 being switched from the locking state to an unlocking state.

As shown in FIG. 13, FIG. 14 and FIG. 15, the control member 106 is configured to be selectively in one of a locking state L1 and an unlocking L2 state. That is to say, the first locking device 54 can be in the locking state L1 or the unlocking state L2. For example, the control member 106 can be rotated and deflected relative to the second component 86 (or the first locking device 54) from the locking state L1 to the unlocking state L2. In particular, the control member 106 can be switched from the locking state L1 to the unlocking state L2, or switched from the unlocking state L2 to the locking state L1 through the first path 112 and the second path 114 of the control path 110. In the present embodiment, when the guiding member 116 is located in the second path 114 of the control path 110 of the first base 46, the control member 106 is in the locking state L1. As such, the control part 108 of the control member 106 does not engage with the engagement section 94 of the second component 86. When an external force is applied to the first base 46, the control member 106 is deflected to allow the guiding member 116 to enter the first path 112 from the second path 114 of the control path 110. As such, the control member 106 is in the unlocking state L2 relative to the second component 86 (or the first locking device 54), and the control part 108 of the control member 106 engages with the engagement section 94 of the second component 86. In other words, the control part 108 of the control member 106 can selectively engage or not engage with the engagement section 94 of the second component 86. On the other hand, a predetermined longitudinal distance X is defined by the first path 112 of the control path 110.

Figure 16:
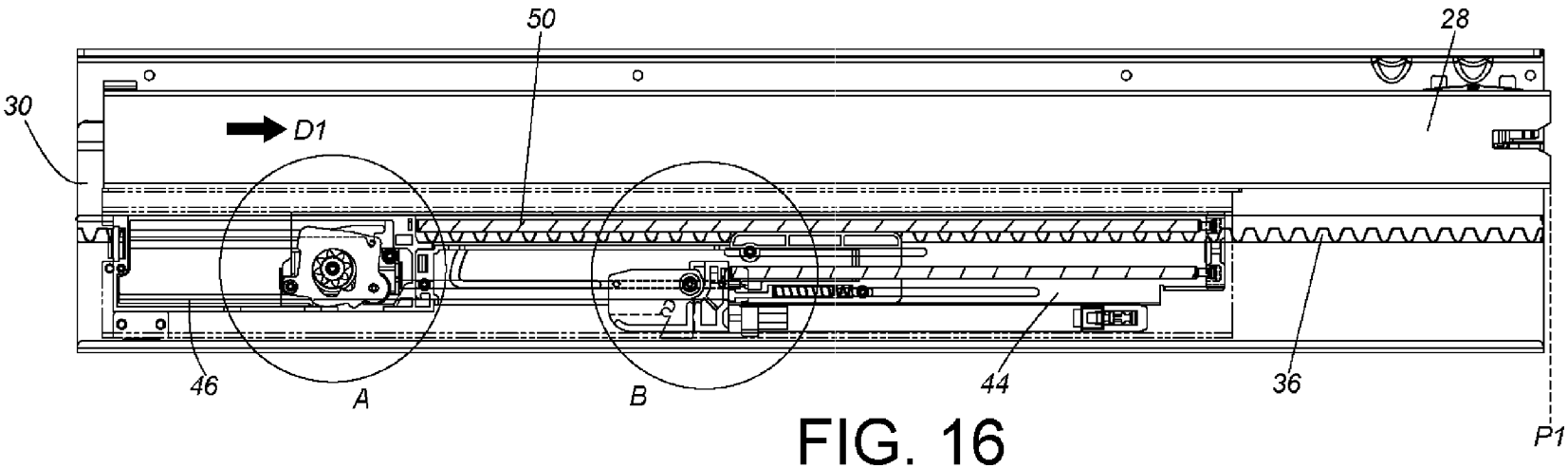
FIG. 16 is a diagram showing a first rail of the slide rail assembly located at a retracted position relative to a second rail, and a first elastic member of the first locking device accumulating a first elastic force along a first direction due to the first locking device being in the locking state according to an embodiment of the present invention.
Figure 18:
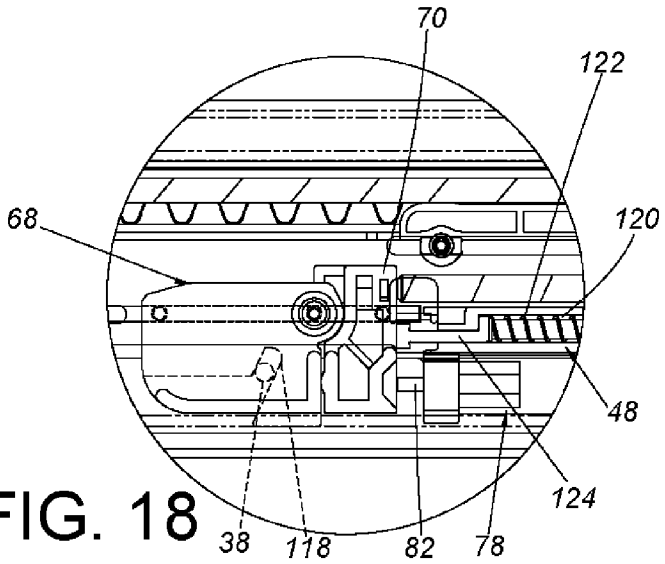
FIG. 18 is an enlarged view of an area B of FIG. 16 for illustrating a capturing member of a second locking device capturing a portion of the second rail, and the driving mechanism comprising a pushing member abutting against a blocking member of the second locking device through an auxiliary elastic member.
Figure 17:
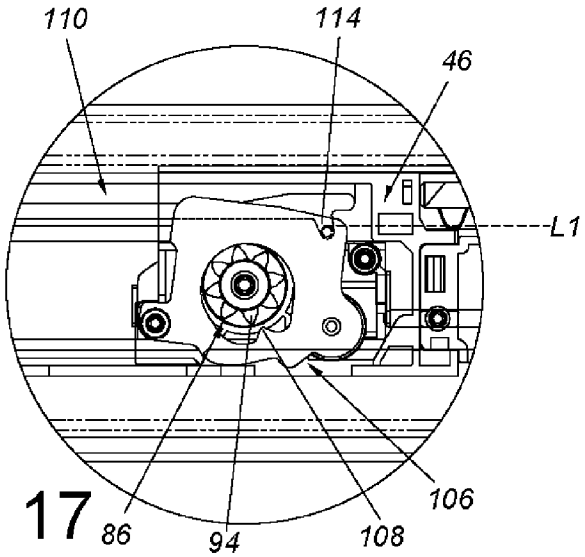
FIG. 17 is an enlarged view of an area A of FIG. 16 for illustrating the first locking device being in the locking state.

As shown in FIG. 16, FIG. 17 and FIG. 18, the first rail 28 is located at a retracted position P1 relative to the second rail 30 (that is, the first furniture part 22 is located at a retracted position P1 relative to the second furniture part 24). As such, the control member 106 is in the locking state L1 due to the guiding member 116 being located in the second path 114 of the control path 110 of the first base 46. When in the locking state L1, the control part 108 of the control member 106 does not engage with the engagement section 94 of the second component 86. In such state, the first component 84 is movable on the auxiliary track 36 along a first direction D1 and a second direction. Since the first component 84 is movable on the auxiliary track 36 along the first direction D1, the first component 84 is movable relative to the second furniture part 24 from the retracted position P1 toward an open position along the first direction D1. In addition, the control member 106 is held in the locking state L1 to allow the first elastic member 50 to accumulate a first elastic force (or a first driving force) applied to the connecting member 44 along the first direction D1. In other words, when the control member 106 of the first locking device 54 locks the first elastic member 50, the first elastic member 50 is configured to accumulate the first elastic force. On the other hand, the capturing member 68 has a capturing feature 118 configured to capture a portion of the second rail 30 (or the second furniture part 24), such as capturing the engagement feature 38. The capturing feature 118 can be a clasp or recessed structure. Preferably, the second base 48 further comprises a room 120. The driving mechanism further comprises an auxiliary elastic member 122 and a pushing member 124 accommodated in the room 120. The auxiliary elastic member 122 is configured to provide an elastic force to the pushing member 124, for allowing the pushing member 124 to be partially extended out of the room 120 to contact the blocking member 70. In addition, the damping rod 82 of the damping device 78 abuts against the blocking member 70.

Figure 19:
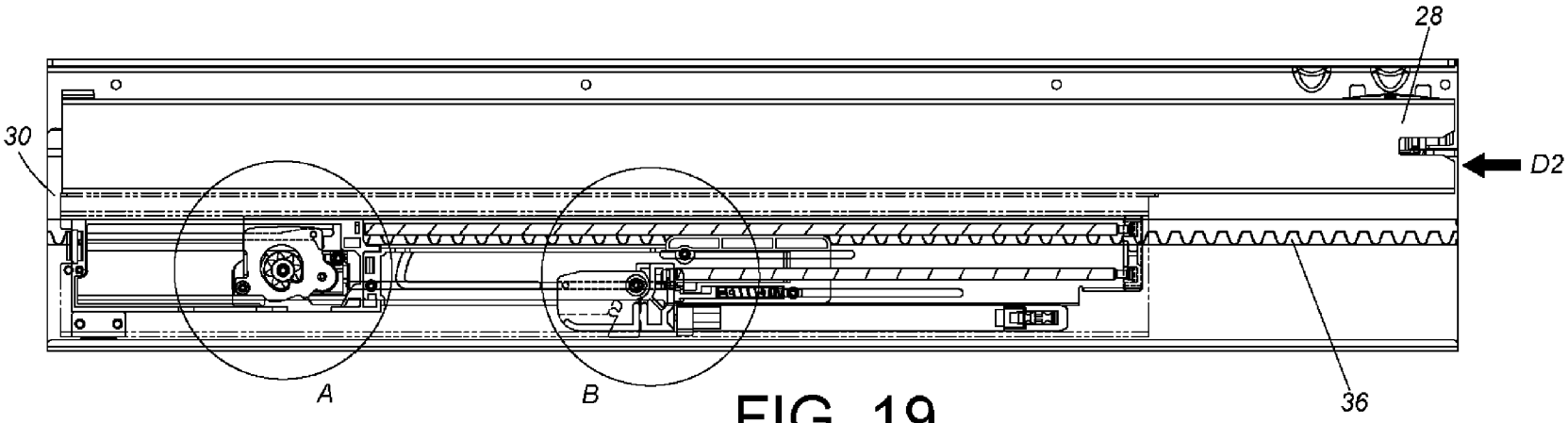
FIG. 19 is a diagram showing the first rail of the slide rail assembly being moved relative to the second rail along a second direction by an external force according to an embodiment of the present invention.
Figure 21:
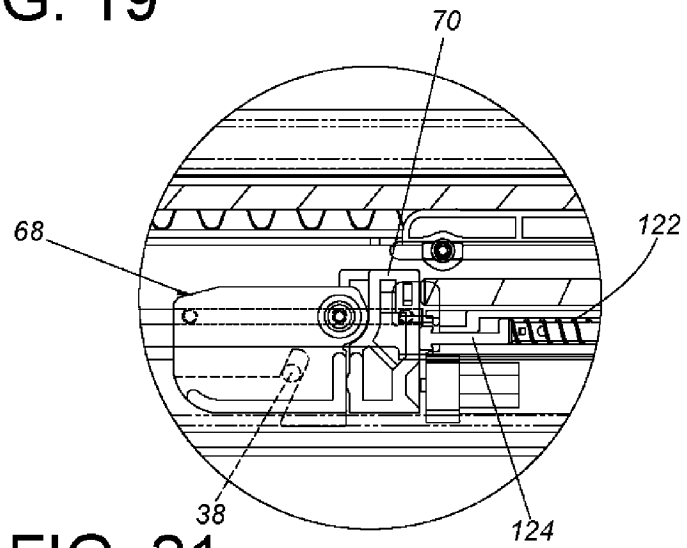
FIG. 21 is an enlarged view of an area B of FIG. 19 for illustrating the capturing member of the second locking device capturing the portion of the second rail, and the pushing member pressing the auxiliary elastic member to move a distance.
Figure 20:
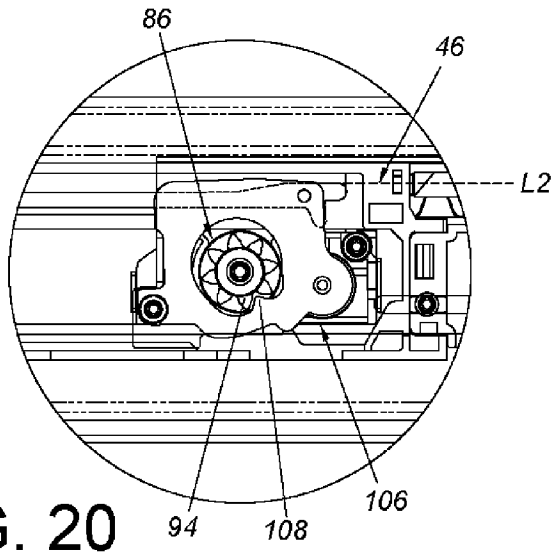
FIG. 20 is an enlarged view of an area A of FIG. 19 for illustrating the first locking device being in the unlocking state.

As shown in FIG. 19, FIG. 20 and FIG. 21, since the capturing member 68 and the engagement feature 38 of the second rail 30 engage with each other, when an external force along the second direction D2 is applied to the first rail 28, the first rail 28 is moved relative to the second rail 30 from the retracted position P1 along the second direction D2. The pushing member 124 then abuts against the blocking member 70 and presses the auxiliary elastic member 122 in response to the external force, such that the first rail 28 is moved a short distance relative to the second rail 30 along the second direction D2. The first base 46 further drives the control member 106 to move from the locking state L1 to the unlocking state L2 in response to the first rail 28 being moved along the second direction D2, such that the control part 108 of the control member 106 can engage with the engagement section 94 of the second component 86 (please refer to FIG. 13, FIG. 14 and FIG. 15 for the process of the control member 106 moving from the locking state L1 to the unlocking state L2, no further illustration is provided for simplification). In such state, the first component 84 is not movable relative to the auxiliary track 36 along the second direction D2 (that is to say, the first component 84 is not movable relative to the second furniture part 24 along the second direction D2). In other words, in such state, the first component 84 is movable on the auxiliary track 36 only along the first direction D1 (the direction opposite to the second direction D2).

Figure 22:
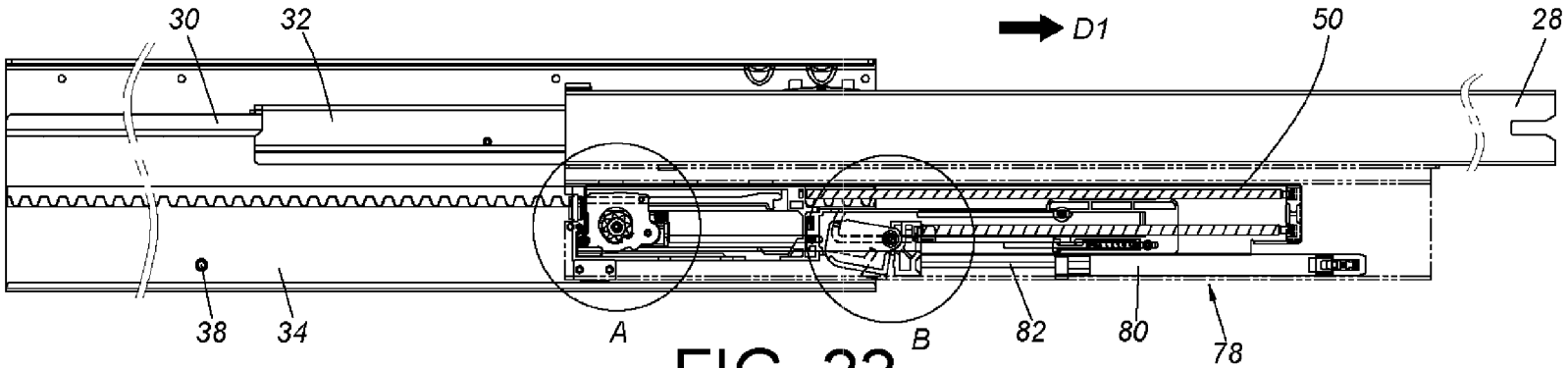
FIG. 22 is a diagram showing the first locking device of the slide rail assembly being in the unlocking state, and the first elastic member releasing an elastic force to drive the first rail to move relative to the second rail along the first direction according to an embodiment of the present invention.
Figure 24:
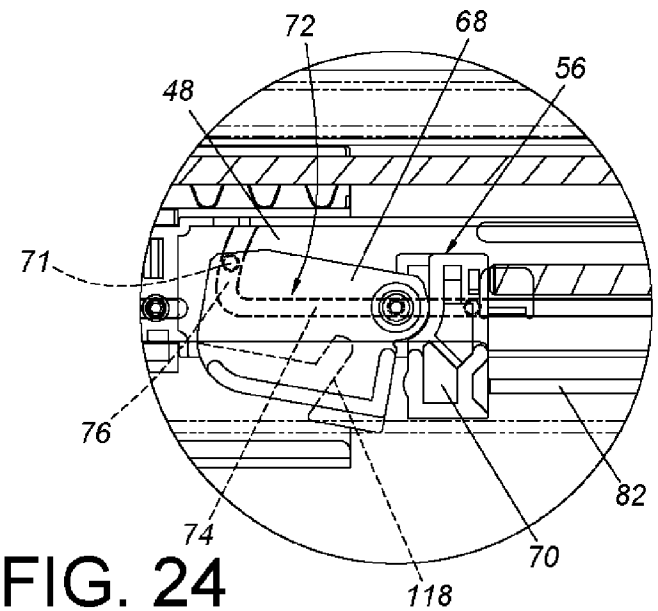
FIG. 24 is an enlarged view of an area B of FIG. 22 for illustrating the capturing member of the second locking device being deflected relative to the blocking member without capturing the portion of the second rail.
Figure 23:
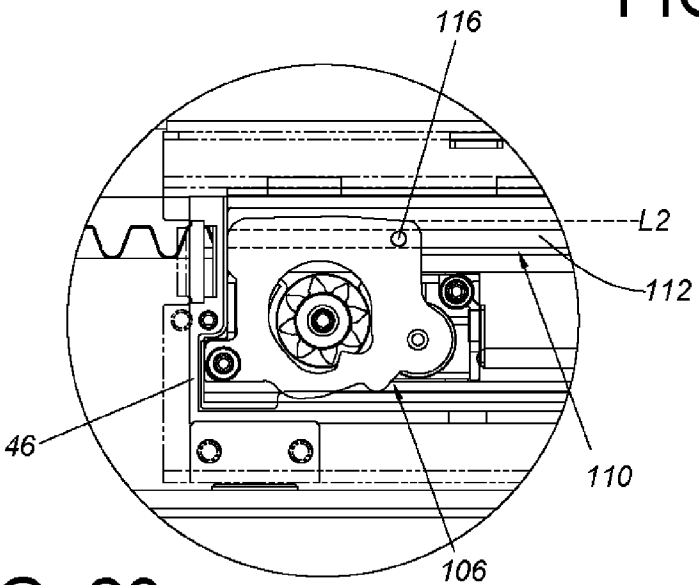
FIG. 23 is an enlarged view of an area A of FIG. 22 for illustrating the first base being located at an end part relative to the first locking device.

As shown in FIG. 22, FIG. 23 and FIG. 24, when the control member 106 is in the unlocking state L2 (that is to say, the guiding member 116 of the control member 106 is located in the first path 112 of the control path 110) and the external force along the second direction D2 no longer exists, the first elastic member 50 releases the first elastic force to drive the first rail 28 to move relative to the second rail 30 from the retracted position P1 along the first direction D1. In other words, when the control member 106 of the first locking device 54 is in the unlocking state L2, the first locking device 54 unlocks the first elastic member 50, such that the first elastic member 50 releases the first elastic force to allow the first base 46 and the second base 48 to move with the first rail 28 along the first direction D1. Briefly, the first rail 28 can be opened relative to the second rail 30 in response to the first elastic force being released by the first elastic member 50. Wherein, when the second base 48 is moved along the first direction D1, the guiding path 72 of the second base 48 is moved relative to the capturing member 68 to allow the first pin 71 of the capturing member 68 to enter the transverse path 76 from the longitudinal path 74 of the guiding path 72. Accordingly, the capturing member 68 is deflected relative to the blocking member 70 in order to detach the capturing feature 118 of the capturing member 68 from the engagement feature 38 on the extension base 34. In addition, the damping rod 82 of the damping device 78 is extended outward relative to the cylinder 80 to be in a damping ready state and corresponds to the blocking member 70 of the second locking device 56.

Figure 25:
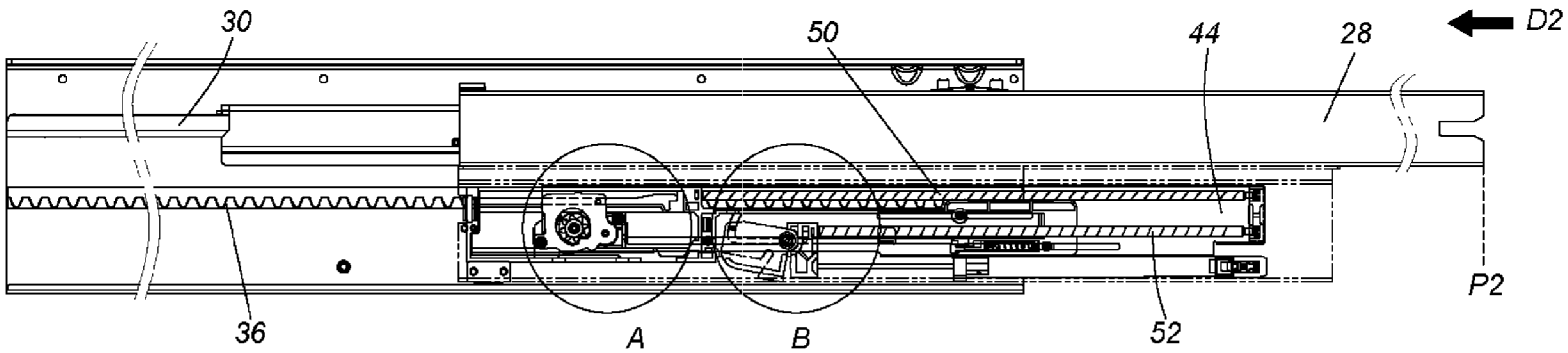
FIG. 25 is a diagram showing the first rail of the slide rail assembly being retracted relative to the second rail from an open position along the second direction according to an embodiment of the present invention.
Figure 26:
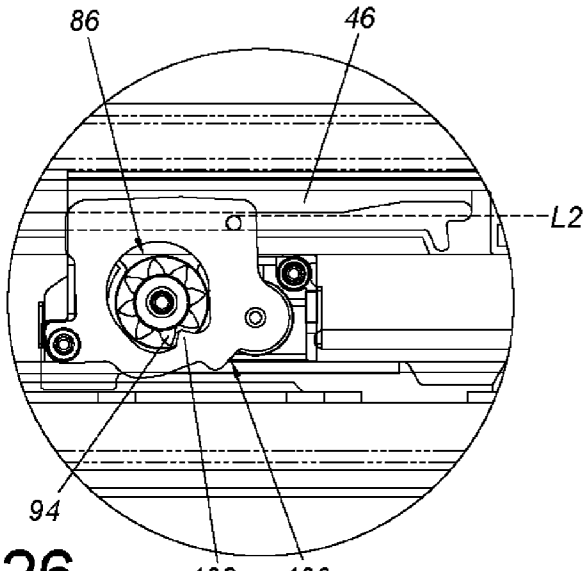
FIG. 26 is an enlarged view of an area A of FIG. 25 for illustrating the first base being moved a distance relative to the first locking device and remaining in the unlocking state.
Figure 27:
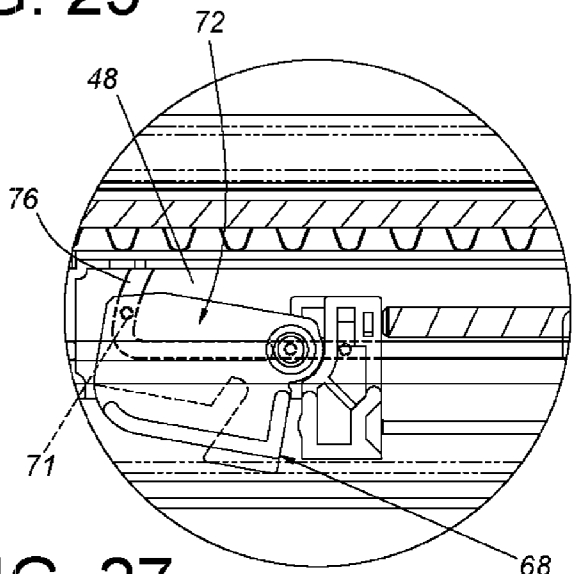
FIG. 27 is an enlarged view of an area B of FIG. 25 for illustrating the capturing member of the second locking device being deflected relative to the blocking member.

As shown in FIG. 25, FIG. 26 and FIG. 27, when the first rail 28 is moved relative to the second rail 30 from an open position P2 along the second direction D2 by an external force (that is to say, the first furniture part 22 is moved relative to the second furniture part 24 from the open position P2 along the second direction D2 by the external force), the first base 46 and the second base 48 are moved with the first rail 28 along the second direction D2. Wherein, since the first locking device 54 is in an engaging state (such as the abutting member 96 in FIG. 8 abutting against the first abutting part 98 of the first component 84 and the second abutting part 100 of the of the second component 86) with the control part 108 of the control member 106 engaging with the engagement section 94 of the second component 86, the first component 84 is not movable on the auxiliary track 36 along the second direction D2. In such state, the first elastic member 50 accumulates a first elastic force in response to the external force, and the second elastic member 52 also accumulates a second elastic force in response to the external force. In particular, when the first base 46 is moved relative to the second rail 30 in response to the external force, the first elastic member 50 is stretched by the first base 46 to accumulate the first elastic force. On the other hand, since the first pin 71 of the capturing member 68 is held in the transverse path 76 of the guiding path 72, the second elastic member 52 is stretched by the second base 48 to accumulate the second elastic force.

Figure 28:
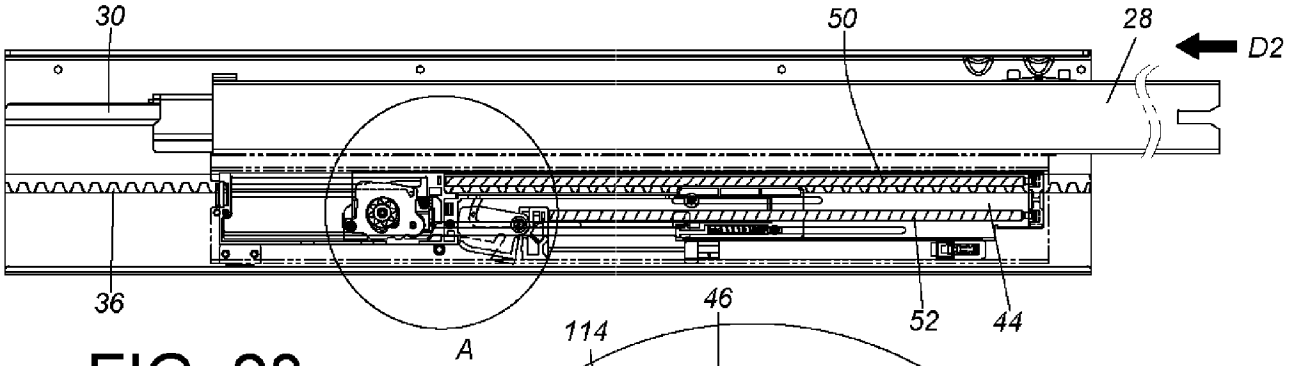
FIG. 28 is a diagram showing the first rail of the slide rail assembly being further retracted relative to the second rail from the open position along the second direction according to an embodiment of the present invention.
Figure 29:
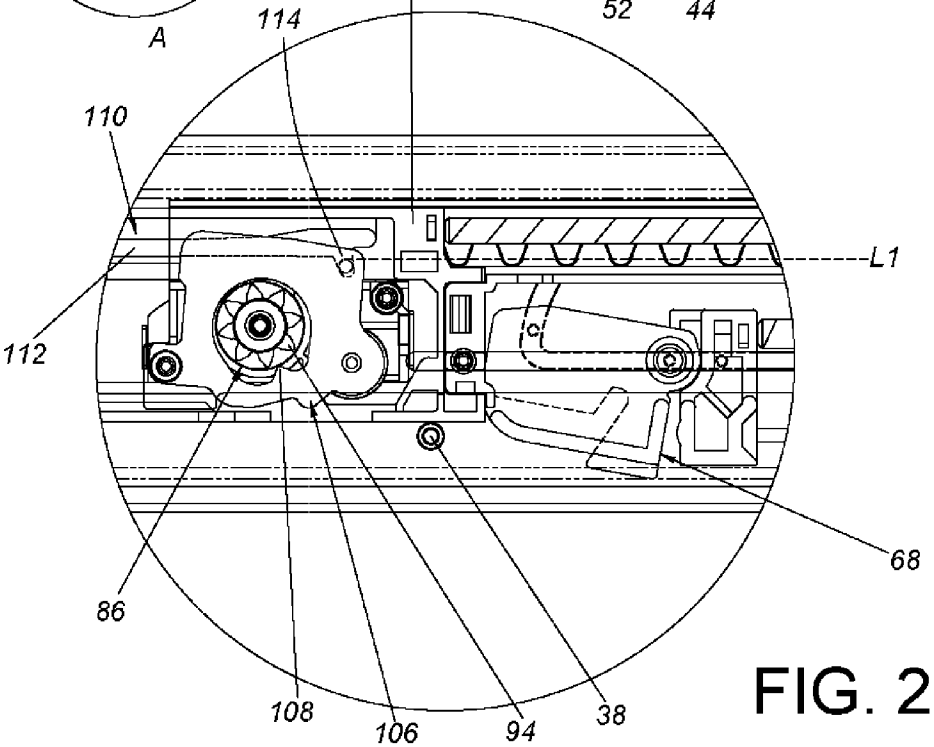
FIG. 29 is an enlarged view of an area A of FIG. 28 for illustrating the first base being moved relative to the first locking device to be in the locking state, and the capturing member of the second locking device being ready to capture the portion of the second rail.

As shown in FIG. 28 and FIG. 29, when the first rail 28 is moved a predetermined distance relative to the second rail 30 from the open position P2 toward the retracted position P1 along the second direction D2 (such as the first rail 28 being moved the longitudinal distance X of the first path 112 of the control path 110), the first base 46 is moved to allow the guiding member 116 of the control member 106 to return to the second path 114 from the first path 112 of the control path 110, such that the control member 106 is switched from the unlocking state L2 back to the locking state L1 relative to the second component 86. Accordingly, the control part 108 of the control member 106 does not engage with the engagement section 94 of the second component 86. In such state, the first elastic member 50 and the second elastic member 52 can respectively accumulate the first elastic force (or the first driving force) and the second elastic force (or the second driving force). In other words, the control member 106 of the first locking device 54 is recovered to the state of locking the first elastic member 50 in response to the first rail 28 being moved the predetermined distance relative to the second rail 30. Wherein, the second elastic force of the second elastic member 52 can be applied to the connecting member 44 along the second direction D2. On the other hand, the capturing member 68 is ready to capture the engagement feature 38 of the second rail 30.

Figure 30:
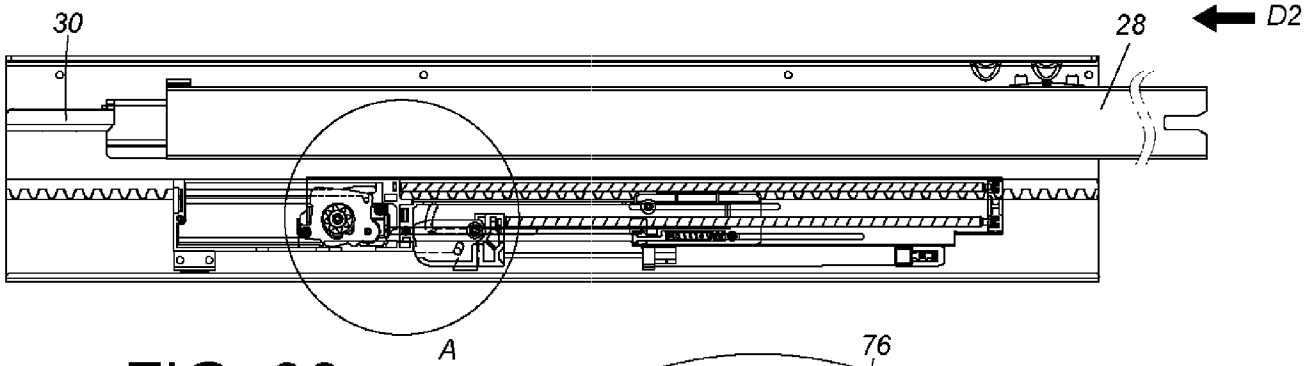
FIG. 30 is a diagram showing the first rail of the slide rail assembly being further retracted relative to the second rail from the open position along the second direction according to an embodiment of the present invention.
Figure 31:
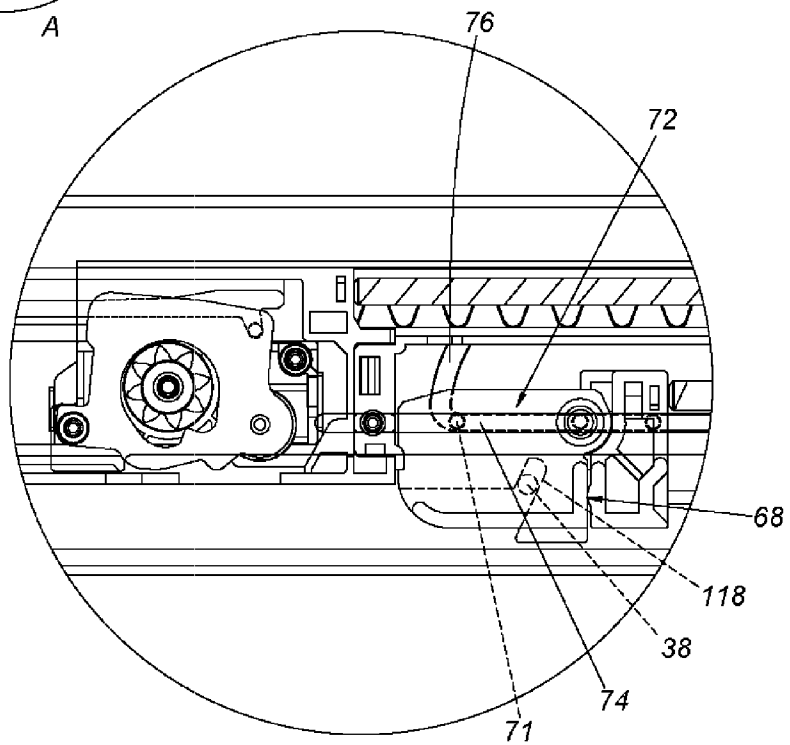
FIG. 31 is an enlarged view of an area A of FIG. 30 for illustrating the first locking device being in the locking state, and the capturing member of the second locking device capturing the portion of the second rail to be deflected.

As shown in FIG. 30 and FIG. 31, in an end process of the first rail 28 being retracted relative to the second rail 30 along the second direction D2, the capturing feature 118 of the capturing member 68 captures the engagement feature 38 of the second rail 30, such that the first pin 71 of the capturing member 68 is moved away from the transverse path 76 to the longitudinal path 74 of the guiding path 72. That is to say, the capturing member 68 is deflected relative to the blocking member 70 to be adjacent to the blocking member 70.

Figure 32:
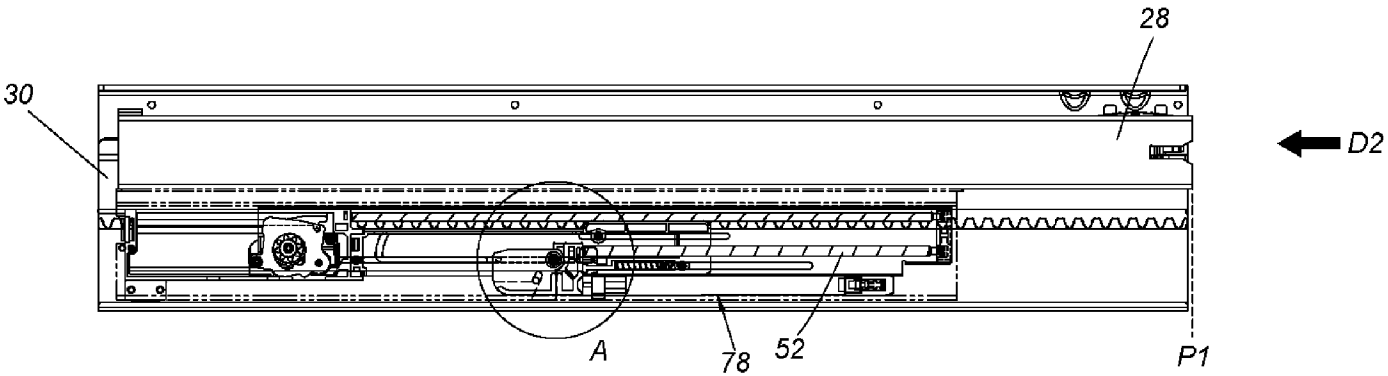
FIG. 32 is a diagram showing the first rail of the slide rail assembly being retracted relative to the second rail along the second direction in response to the second elastic force of the second elastic member according to an embodiment of the present invention.
Figure 33:
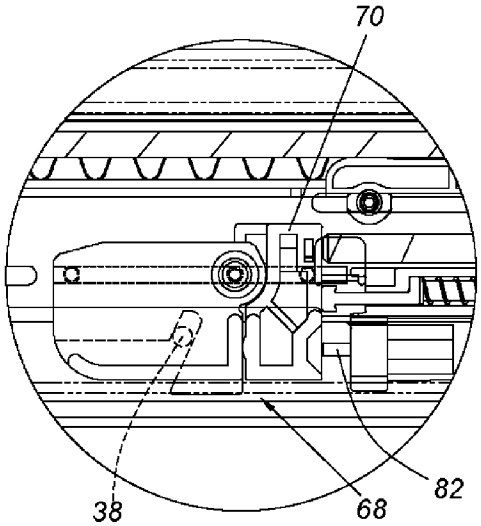
FIG. 33 is an enlarged view of an area A of FIG. 32 for illustrating a damping device providing damping effect when the first rail is retracted relative to the second rail along the second direction.

As shown in FIG. 32 and FIG. 33, when the capturing member 68 captures the engagement feature 38 of the second rail 30, the second elastic member 52 releases the second elastic force, such that the first rail 28 is retracted relative to the second rail 30 to the retracted position P1 along the second direction D2 in response to the second elastic force. In other words, the first furniture part 22 can be moved relative to the second furniture part 24 from the open position P2 to the retracted position P1 along the second direction D2 in response to the second elastic force. In addition, since the damping rod 82 of the damping device 78 abuts against the blocking member 70, the damping member 78 is configured to provide damping effect in the process of retracting the first rail 28 to the retracted position P1 relative to the second rail 30.

Moreover, the present invention further provides a driving method for the first furniture part 22 and the second furniture part 24. The driving method is disclosed in the aforementioned embodiments. For simplification, no further illustration is provided.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving mechanism, configured to drive a first furniture part to move relative to a second furniture part, the driving mechanism comprising:

a first elastic member;

a first locking device configured to releasably lock the first elastic member, wherein when the first locking device locks the first elastic member, the first elastic member accumulates a first elastic force; and when the first locking device releases the first elastic member, the first elastic member releases the first elastic force to drive the first furniture part to move relative to the second furniture part from a retracted position toward an open position along a first direction;

a second elastic member; and a second locking device connected to the second elastic member, wherein when the first furniture part is moved a predetermined distance relative to the second furniture part from the open position toward the retracted position along a second direction, the first locking device is switched from an unlocking state to a locking state in order to lock the first elastic member, and the second elastic member generates a second elastic force, such that the first furniture part is moved relative to the second furniture part from the open position to the retracted position along the second direction in response to the second elastic force.

2. The driving mechanism of claim 1, wherein the first locking device comprises a first component, a second component and a control member, the first component is movable on the second furniture part, the second component is movably connected to the first component, and the control member is configured to be selectively in one of the locking state and the unlocking state.

3. The driving mechanism of claim 2, wherein the control member has a control part, when the control member is in the unlocking state, the control part of the control member engages with the second component; and when the control member is in the locking state, the control part of the control member does not engage with the second component.

4. The driving mechanism of claim 2, wherein the second furniture part comprises an auxiliary track arranged along a longitudinal direction of the second furniture part, and the first component is movable along the auxiliary track.

5. The driving mechanism of claim 2, further comprising a first base connected to the first furniture part, wherein one of the first base and the control member has a control path, the control path comprises a first path and a second path deflected relative to the first path, the control path is configured to move the control member to be in one of the locking state and the unlocking state, and the predetermined distance is defined by the first path.

6. The driving mechanism of claim 5, further comprising a second base arranged adjacent to the first base, wherein the second base has a guiding path, the guiding path comprises a longitudinal path and a transverse path deflected relative to the longitudinal path, the second locking device comprises a capturing member and a blocking member movably connected to the capturing member, the capturing member and the blocking member are movable along the longitudinal path of the guiding path, and the capturing member is configured to capture a portion of the second furniture part.

7. The driving mechanism of claim 6, further comprising a connecting member movable relative to the first furniture part, wherein the first locking device is arranged on the connecting member, the connecting member has a first mounting part and a second mounting part, the first elastic member is mounted between the first base and the first mounting part, and the second elastic member is mounted between the blocking member and the second mounting part.

8. The driving mechanism of claim 7, wherein the first base has a fixing member, the connecting member is arranged with an extension hole located at a position corresponding to the fixing member, the connecting member is movable relative to the first base through the extension hole, the fixing member passes through a portion of the extension hole and is connected to the first furniture part.

9. The driving mechanism of claim 8, wherein the fixing member and the extension hole respectively are a protrusion and a bounded hole.

10. The driving mechanism of claim 6, further comprising a damping device having a damping rod located at a position corresponding to one of the blocking member and the capturing member.

11. The driving mechanism of claim 6, wherein the second base further comprises a room, the driving mechanism further comprises an auxiliary elastic member and a pushing member accommodated in the room, the auxiliary elastic member is configured to provide an elastic force to the pushing member, and the pushing member is partially extended out of the room.

12. The driving mechanism of claim 2, wherein the control member is pivoted relative to the second component.

13. The driving mechanism of claim 2, wherein the first locking device further comprises at least one abutting member movably mounted between the first component and the second component, the first component has a first abutting part, the second component has a second abutting part, an abutting space is defined by the first abutting part and the second abutting part and configured to accommodate the abutting member, when the abutting member is located at a predetermined position, the abutting member abuts against the first component and the second component, and when the abutting member is moved away from the predetermined position, the abutting member does not abut against the first component and the second component.

14. A furniture assembly, comprising:

a first furniture part;

a second furniture part, wherein the first furniture part is movable relative to the second furniture part from a retracted position toward an open position; and a driving mechanism comprising a first locking device, the first locking device comprising:

a first component movable on the second furniture part;

a second component movably connected to the first component; and a control member configured to be in one of a locking state and an unlocking state relative to the second component;

wherein when the control member is in the locking state, the control member does not engage with the second component, such that the first component can be moved relative to the second furniture part from the retracted position toward the open position along a first direction;

wherein when the control member is in the unlocking state, the control member engages with the second component, such that the first component is not movable relative to the second furniture part along a second direction;

wherein when the first furniture part is moved a predetermined distance relative to the second furniture part from the open position toward the retracted position along the second direction, the control member is switched from the unlocking state to the locking state.

15. The furniture assembly of claim 14, wherein the driving mechanism further comprises a first base, one of the first base and the control member has a control path, the control path comprises a first path and a second path deflected relative to the first path, the control path is configured to move the control member to be in one of the locking state and the unlocking state, and the predetermined distance is defined by the first path.

16. The furniture assembly of claim 15, wherein the driving mechanism further comprises a first elastic member, when the first furniture part is moved relative to the second furniture part from the open position toward the retracted position along the second direction, the first elastic member is configured to accumulate a first elastic force in response to the control member being switched from the unlocking state to the locking state, the first elastic force is configured to drive the first furniture part to move relative to the second furniture part from the retracted position toward the open position along the first direction.

17. The furniture assembly of claim 16, wherein the driving mechanism further comprises a second elastic member, the second elastic member is configured to accumulate a second elastic force in response to the control member being switched from the unlocking state to the locking state, the second elastic force is configured to drive the first furniture part to move relative to the second furniture part from the open position toward the retracted position along the second direction.

18. The furniture assembly of claim 17, wherein the driving mechanism further comprises a second base and a second locking device, the second base is arranged adjacent to the first base, the second base has a guiding path, the guiding path comprises a longitudinal path and a transverse path deflected relative to the longitudinal path, the second locking device comprises a capturing member and a blocking member movably connected to the capturing member, the capturing member and the blocking member are movable along the longitudinal path of the guiding path, the capturing member is configured to capture a portion of the second furniture part, the driving mechanism further comprises a connecting member having a first mounting part and a second mounting part, the first elastic member is mounted between the first base and the first mounting part, and the second elastic member is mounted between the blocking member and the second mounting part.

19. The furniture assembly of claim 18, wherein the driving mechanism further comprises a damping device having a damping rod located at a position corresponding to one of the blocking member and the capturing member.

20. A driving method for moving a first furniture part relative to a second furniture part, the first furniture part being movable relative to the second furniture part from a retracted position toward an open position along a first direction, the driving method comprising:

providing a first elastic member;

providing a first locking device configured to releasably lock the first elastic member, wherein when the first furniture part is moved relative to the second furniture part along a second direction by an external force to allow the first locking device to unlock the first elastic member, the first elastic member releases a first elastic force, and the first furniture part is moved relative to the second furniture part from the retracted position to the open position along the first direction in response to the first elastic force; and providing a second elastic member;

wherein when the first furniture part is moved a predetermined distance relative to the second furniture part from the open position toward the retracted position by an external force to allow the first locking device to lock the first elastic member, the second elastic member is configured to release a second elastic force, and the first furniture part is moved relative to the second furniture part form the open position to the retracted position along the second direction in response to the second elastic force.

* * * * *